US011261059B2

(12) United States Patent
Helenius et al.

(10) Patent No.: US 11,261,059 B2
(45) Date of Patent: Mar. 1, 2022

(54) ELEVATOR DRIVE MACHINERY AND ELEVATOR

(71) Applicant: Kone Corporation, Helsinki (FI)

(72) Inventors: Juha Helenius, Helsinki (FI); Raimo Pelto-Huikko, Helsinki (FI)

(73) Assignee: Kone Corporation, Helsinki (FI)

( * ) Notice: Subject to any disclaimer, the term of this patent is extended or adjusted under 35 U.S.C. 154(b) by 301 days.

(21) Appl. No.: 16/390,267

(22) Filed: Apr. 22, 2019

(65) Prior Publication Data

US 2019/0375612 A1 Dec. 12, 2019

(30) Foreign Application Priority Data

Jun. 6, 2018 (EP) ..... 18176236

(51) Int. Cl.
*B66B 7/10* (2006.01)
*B66B 1/28* (2006.01)
(Continued)

(52) U.S. Cl.
CPC ..... *B66B 7/10* (2013.01); *B66B 1/28* (2013.01); *B66B 7/062* (2013.01); *B66B 11/043* (2013.01);
(Continued)

(58) Field of Classification Search
CPC ..... B66B 7/10; B66B 11/043; B66B 15/08; B66B 15/04; B66B 1/28
See application file for complete search history.

(56) References Cited

U.S. PATENT DOCUMENTS 921,646 A * 5/1909 Larson ..... B66B 11/0484 254/290
1,974,361 A 9/1934 La Neve
(Continued)

FOREIGN PATENT DOCUMENTS

DE 457695 C 3/1928
DE 460448 C 5/1928
(Continued)

OTHER PUBLICATIONS

European Search Report with Application No. 18176236.0 dated Jul. 12, 2018.

*Primary Examiner* — Michael R Mansen
*Assistant Examiner* — Michelle M Lantrip
(74) *Attorney, Agent, or Firm* — Harness, Dickey & Pierce, P.L.C.

(57) ABSTRACT

The invention relates to an a drive machinery for an elevator, the drive machinery comprising a rotatable drive sheave for driving plurality of ropes of the elevator, the drive sheave comprising a central cylinder, which comprises a central axis around which the central cylinder is rotatable; plurality of circular rim members surrounding the central cylinder, each said rim member comprising an outer rim surface for engaging a rope. Said plurality of circular rim members includes one or more rotatably mounted circular rim members, each said rotatably mounted circular rim member being mounted on the central cylinder rotatably around said central axis relative to the central cylinder and relative to one or more of the other circular rim members, and in that said drive sheave moreover comprises a control means for controlling rotation of each said rotatably mounted circular rim member relative to the central cylinder and relative to one or more of the other circular rim members. The invention also relates to an elevator implementing the drive machinery.

21 Claims, 8 Drawing Sheets

(51) Int. Cl.

| | |
|---|---|
| ***B66B 7/06*** | (2006.01) |
| ***B66B 11/04*** | (2006.01) |
| ***B66B 15/04*** | (2006.01) |
| ***B66B 15/08*** | (2006.01) |

(52) U.S. Cl.
CPC ..... *B66B 11/0423* (2013.01); *B66B 15/04* (2013.01); *B66B 15/08* (2013.01)

(56) References Cited

U.S. PATENT DOCUMENTS

| | | | | | |
|---|---|---|---|---|---|
| 3,332,665 | A * | 7/1967 | Bruns | B66D 3/06 | 254/393 |
| 3,645,519 | A * | 2/1972 | Schwarz | B66B 7/10 | 266/226 |
| 4,568,316 | A * | 2/1986 | Veikley | B66D 3/08 | 474/168 |
| 10,246,303 | B2 * | 4/2019 | Lampinen | B66B 9/00 | |
| 10,556,777 | B2 * | 2/2020 | Salmi | F16H 57/0471 | |

FOREIGN PATENT DOCUMENTS

| | | | | |
|---|---|---|---|---|
| DE | 859362 | C | 12/1952 | |
| DE | 102006056678 | A1 * | 6/2008 | B66B 15/08 |
| FI | 84803 | B | 10/1991 | |
| WO | WO-2015024187 | A1 * | 2/2015 | B66B 15/04 |

* cited by examiner

ELEVATOR DRIVE MACHINERY AND ELEVATOR

This application claims priority to European patent application no. EP18176236.0 filed on Jun. 6, 2018, the entire contents of which are incorporated herein by reference.

FIELD OF THE INVENTION

The invention relates to an elevator drive machinery and an elevator utilizing the drive machinery. The elevator is preferably an elevator for transporting passengers and/or goods.

BACKGROUND OF THE INVENTION

Elevators typically comprise a drive sheave and a roping comprising ropes connected with the elevator car and passing around the drive wheel. Via the ropes traction force can be transmitted from the drive sheave to the car. Thereby, car movement can be achieved and controlled by the drive sheave. The drive sheave can be rotatable by an electric motor, for example.

The ropes driven by the drive sheave are typically connected on one side of the drive sheave with the elevator car and on the other side with a counterweight.

Traction sheave elevators are prone to having uneven rope forces. Ideally, parallel ropes would have equal forces, but in practice rope force differences exist in the elevator due to non-idealities, such as rope thickness variation, rope stiffness variation, rope coating thickness variation or rope groove diameter variation. If there are differences in the effective pulley diameter for ropes of a single elevator, the ropes will experience travel differences as the elevator is run.

Especially high friction ropes, such as ropes having a polymer coating, are easily subjected to large force variations due to their small slip on the drive sheave. Large rope force variations occurring on every roundtrip cause excessive fatigue loads on load bearing components, such as rope fixings, ropes themselves and guide shoes. They also cause ride comfort problems, increase pulley wear rate and reduce rope lifetime. Problems of rope force variation may also be faced with ropes engaging with positive engagement with the drive sheave.

There are known solutions for equalizing rope tensions of individual ropes of a roping, where there are rope tension equalizers at the rope ends. Such a solution has been presented in document FI84803B, for example. Another known solution is to fix the rope ends via spring members so that the forces are transmitted from the rope to the fixing base via a spring enabling movement of the rope end relative to the fixing base. A drawback of these known solutions is that they allow only very limited range of movement of the rope ends. When an end of the range is reached, rope forces cannot be equalized further.

It has been noticed that with high friction ropes, such as ropes having a polymer coating, there is little or virtually no slip between ropes and the traction sheave, so the travel differences are hardly compensated by slip unlike in the case of steel ropes. When the travel differences are not compensated, ropes having different free lengths have to be elongated to the same length between hitch plate and traction sheave. Different elongations cause uneven rope forces especially when the car or the counterweight is approaching the top of the hoistway, because in this case suspension ropes are short and their stiffness is high.

It has also been noticed that rope travel differences accumulate with each rotation of the traction sheave. Long travel distance of the elevator, small traction sheave and 2:1 suspension increase the number of rotations of the sheave and worsen the problem. The lower is the headroom, the shorter and stiffer are the suspension ropes as the car or the counterweight is at the top of the hoistway.

It has therefore been noticed a drawback that the ability of prior solutions to equalize tension is the most problematic in elevators which have one or more of the following: long travel distance, low amount of slip, small diameter of the traction sheave and 2:1 suspension, low head room.

BRIEF DESCRIPTION OF THE INVENTION

The object of the invention is to provide a solution which is improved in terms of rope tension equalization of elevator ropes to be driven by a drive machinery. An object is particularly to alleviate one or more of the above defined drawbacks of prior art and/or problems discussed or implied elsewhere in the description. Solutions are presented, inter alia, by which an elevator can be achieved which has reduced variation of tension between individual ropes. Solutions are presented, inter alia, whereby this can be achieved even though the elevator has one or plurality of the following: long travel distance, low amount of slip, small diameter of the traction sheave and 2:1 suspension, low head room.

It is brought forward a new drive machinery for an elevator comprising a rotatable drive sheave for driving plurality of ropes of the elevator, the drive sheave comprising a central cylinder, which comprises a central axis around which the central cylinder is rotatable; plurality of circular rim members surrounding the central cylinder, each said rim member comprising an outer rim surface for engaging a rope. The drive sheave is arranged to exert traction via the circular rim members on the ropes passing around them. Said plurality of circular rim members includes one or more rotatably mounted circular rim members, each said rotatably mounted circular rim member being mounted, preferably via bearings, on the central cylinder rotatably around said central axis relative to the central cylinder and relative to one or more of the other circular rim members, and said drive sheave moreover comprises a control means for controlling rotation of each said rotatably mounted circular rim member relative to the central cylinder and relative to one or more of the other circular rim members. With the control means, it is possible to control transmission of force between the central cylinder and an individual rotatably mounted circular rim member. Hereby, a tension difference (which is generated by car position change) between a rope passing around said rotatably mounted circular rim member and ropes passing around the other circular rim members, can be eliminated.

With this solution, one or more of the above mentioned advantages and/or objectives are achieved. Preferable further features are introduced in the following, which further features can be combined with the drive machinery individually or in any combination.

In a preferred embodiment, said control means are electrically controllable. Particularly preferably, said control means are controllable with an electrical control signal. This gives freedom to use variables as basis of the control. The variables may then be obtained by measuring, e.g. rope tension(s), and compared with a reference. Such variables include particularly tension of an individual rope passing around the rotatably mounted circular rim member rotation of which can be controlled by the control means as above described.

In a preferred embodiment, each said movably mounted circular rim member comprises only one outer rim surface suitable for engaging/arranged to engage only one rope. Thus, the rim member in question can individually control tension of the rope passing around it.

In a preferred embodiment, each said rotatably mounted circular rim member is arranged to be rotated by the central cylinder via the control means. The control means are arranged to transmit forces between the central cylinder and the rotatably mounted circular rim member.

In a preferred embodiment, the drive machinery moreover comprises a motor for rotating the central cylinder of the drive sheave.

In a preferred embodiment, the motor for rotating the central cylinder is arranged to produce forces for rotating the one or more rotatably mounted circular rim members, said forces being arranged to be transmitted from the motor to the central cylinder and further therefrom to the one or more rotatably mounted circular rim members via the control means.

In a preferred embodiment, the central cylinder is immovably fixed on or integral with the rotor of the motor. Alternatively, there could be a force transmission, such as gears, between the motor and the central cylinder.

In a preferred embodiment, the control means are for controlling rotation of each said rotatably mounted circular rim member relative to the central cylinder and relative to all the other circular rim members of the drive sheave. This facilitates individual control of rotation and tension of an individual rotatably mounted circular rim member.

In a preferred embodiment, each said rotatably mounted circular rim member is mounted via bearings on the central cylinder, said bearings preferably including sliding bearings and/or rolling element bearings such as ball bearings or roller bearings.

In a preferred embodiment, each said rotatably mounted circular rim member is mounted, preferably via bearings on the central cylinder, said bearings preferably including sliding bearings and/or rolling element bearings such as ball bearings or roller bearings, such that it is rotatable relative to the central cylinder as well as relative to one or more of the other rim members an unlimited rotation angle. Hereby, tension difference generated by car position change between a rope passing around said rotatably mounted circular rim member and a rope passing around the circular rim members in question can be eliminated regardless of the amount of needed relative rotation.

In a preferred embodiment, the central cylinder is at least partly hollow such that it comprises an inside space for accommodating preferably completely, but at least partly said control means.

In a preferred embodiment, the central cylinder comprises one or more openings leading radially out from the inside space and the control means extend, preferably the control means comprise one or more operating members extending, via said one or more openings into contact with the one or more rotatably mounted circular rim members.

In a preferred embodiment, said control means are mounted via mounting means on the central cylinder, whereby they are rotatable together with the central cylinder around said central axis.

In a preferred embodiment, most of the circular rim members of the drive sheave, preferably all or all but one, of the circular rim members of the drive sheave are rotatably mounted circular rim members as defined.

In a preferred embodiment, maximal speed (rpm) of rotation of the rotatably mounted circular rim member relative to the central cylinder and relative to one or more of the other circular rim members is substantially smaller than maximal speed (rpm) of rotation of the central cylinder.

In a preferred embodiment, said means comprises a motor (also hereinafter referred to as a control motor) electrically controllable to rotate the rotatably mounted circular rim member relative to the central cylinder as well as relative to one or more of the other circular rim members. The motor is preferably an electric motor. Preferably, although not necessarily, the control means comprises a control motor per each said rotatably mounted circular rim member, which control motor is electrically controllable to rotate the rotatably mounted circular rim member in question relative to the central cylinder as well as relative to one or more of the other circular rim members.

In a preferred embodiment utilizing a control motor, the control motor is electrically controllable to reduce or increase the angular velocity of the rotatably mounted circular rim member relative to the angular velocity of the central cylinder and/or the other circular rim members, in particular during rotation of the central cylinder. The rotatably mounted circular rim can thus be controlled to rotate with an angular velocity different from the angular velocity of the central cylinder and/or other circular rim members.

In a preferred embodiment utilizing a control motor, the control motor is preferably operatively connected to the rotatably mounted circular rim member by force transmission. To facilitate individual controllability of only one rotatably mounted circular rim member and the tension situation of the rope passing around it, the control motor is most preferably operatively connected to only one circular rim member.

In a preferred embodiment utilizing a control motor, said rotatably mounted circular rim member comprises a tooth pattern and said control motor is arranged to rotate a toothed sheave meshing with said tooth pattern. Preferably, the diameter of the toothed sheave is substantially smaller than diameter of the rim member.

In a preferred embodiment utilizing a control motor, the tooth pattern is circular forming a full circle of teeth. Thus, the tooth pattern does not limit angle of rotation between the rotatably mounted circular rim member and the central cylinder.

In a preferred embodiment utilizing a control motor, the control motor is rigidly mounted on the central cylinder. Then, preferably said motor is rigidly mounted on inner side of the central cylinder which side faces towards the central axis.

In a preferred embodiment utilizing a control motor, the control motor preferably comprises an input for an electrical control signal, which can be a control signal transmitted via wired or wireless connection.

In a first kind of a preferred embodiment utilizing a control motor, said toothed sheave has rotational axis parallel with the aforementioned central axis. Preferably, then said rotatably mounted circular rim member comprises said tooth pattern on its inner side facing towards the central axis. Preferably, the tooth pattern then forms a full circle of teeth along inner side of said rotatably mounted circular rim member.

In a second kind of a preferred embodiment utilizing a control motor, said toothed sheave has rotational axis orthogonal to the aforementioned central axis. Then, it is preferable that said toothed sheave is preferably positioned outside the central cylinder. Then, it is preferable that said rotatably mounted circular rim member comprises said tooth pattern on its side facing in longitudinal direction of the central axis. Also in the second kind of preferred embodiment utilizing a control motor, the tooth pattern is preferably circular forming a full circle of teeth. Thus, the tooth pattern does not limit angle of rotation between the rotatably mounted circular rim member 4 and the central cylinder. Then, it is preferable that it forms a full circle of teeth along the side of said rotatably mounted circular rim member facing in longitudinal direction of the central axis.

In the second kind of preferred embodiment utilizing a control motor, it is preferable that the motor has rotational axis orthogonal to the aforementioned central axis. The motor may have an integrated torque sensor.

In a preferred embodiment utilizing a control motor, all of the circular rim members of the drive sheave are rotatably mounted circular rim members, each being rotatable by a control motor relative to the central cylinder and relative to one or more of the other circular rim members. Preferably, although not necessarily, the control means then comprises a control motor per each said rotatably mounted circular rim member, which control motor is electrically controllable to rotate the rotatably mounted circular rim member in question relative to the central cylinder and relative to one or more of the other circular rim members.

In a preferred embodiment utilizing a releasable locking mechanism, said control means comprises a releasable locking mechanism for locking the rotatably mounted circular rim member to be immovable relative to the central cylinder, which releasable locking mechanism is releasable to allow rotation of the rotatably mounted circular rim member relative to the central cylinder as well as relative to one or more of the other circular rim members, said control means further comprising an electrically controllable actuator for moving said locking mechanism between released and locked state.

In a preferred embodiment utilizing a releasable locking mechanism, the releasable locking mechanism comprises a tooth pattern provided on the rotatably mounted circular rim member, and a locking member comprising one or more parts movable to and from a space between two teeth of the tooth pattern for changing the state of the locking mechanism. The tooth pattern is preferably circular forming a full circle of teeth.

In a preferred embodiment utilizing a releasable locking mechanism, said rotatably mounted circular rim member comprises said tooth pattern on its inner side facing towards the central axis. Then, the locking member is preferably at least partly inside the inside space of the central cylinder.

In a preferred embodiment utilizing a releasable locking mechanism, the locking member is a pendulum pivotal back and forth around an axis, in particular by said electrically controllable actuator alone or possibly together with other actuators or spring members, the pendulum comprising one or more parts, in particular distal end parts, movable by pivoting to and from a space between two teeth of the tooth pattern for changing the state of the locking mechanism, one of said parts being between two teeth of the tooth pattern when the other of said parts is not between two teeth of the tooth pattern, and vice versa.

In a preferred embodiment utilizing a hydraulic motor, said control means comprises a hydraulic motor operatively connected to a rotatably mounted circular rim member for rotating it relative to the central cylinder as well as relative to one or more of the other circular rim members.

In a preferred embodiment utilizing a brake, said control means comprises a brake for braking rotation of the rotatably mounted circular rim member relative to the central cylinder, and a controlling means for controlling the brake.

In a preferred embodiment utilizing a brake, said brake, comprises a pack of wheels including engagement wheels engaging a rotatably mounted circular rim member, the engagement wheels being mounted on a shaft of the pack rotatably, and clutch wheels mounted on the shaft of the pack unrotatably, and a compression means, such as a spring, for compressing the engagement wheels and clutch wheels together such that clutch wheels resist rotation of the engagement wheels.

In a preferred embodiment utilizing a brake, said controlling means for controlling the brake are controllable to relieve said compression.

In a preferred embodiment utilizing a brake, said controlling means comprises a mounting means by which said pack of plates is mounted movably such that it can be moved by force exerted by the rotatably mounted circular rim member on said engagement plates against a hydraulic pressure, and said controlling means is arranged to relieve the aforementioned compression of the wheel pack when said pressure exceeds a reference pressure or the pack reaches a preset position.

In a preferred embodiment utilizing a hydraulic motor, said control means comprises plurality of hydraulic motors each operatively connected to only one rotatably mounted circular rim member for rotating it relative to the central cylinder as well as relative to one or more of the other circular rim members, all said hydraulic motors being rotatable by hydraulic fluid supplied to all said hydraulic motors with equal pressure. The input of each hydraulic motor is preferably provided with non-return valve.

It is brought forward a new elevator comprising a drive machinery as described above, and plurality of ropes arranged to pass around the drive sheave thereof.

With this solution, one or more of the above mentioned advantages and/or objectives are achieved. Preferable further features are introduced in the following, as well as above in context of description of the drive machinery, which further features can be combined with the elevator individually or in any combination.

In a preferred embodiment, each said rope comprises a coating forming the outer surface of the rope. The coating is in contact with the outer rim surface of a circular rim member of the drive sheave and the coating comprises polymer material.

In a preferred embodiment, the rope comprises load bearing members extending in longitudinal direction of the rope throughout the length thereof. The load bearing members are preferably embedded in the aforementioned coating forming the outer surface of the rope.

In a preferred embodiment, the elevator comprises a hoistway, an elevator car vertically moveable in the hoistway, and an elevator control, which is configured to automatically control the motor of the machinery. The elevator comprises plurality of ropes passing around the drive sheave, each resting against an outer rim surface of the drive sheave. The elevator preferably moreover comprises a counterweight and the ropes interconnect the car and counterweight. The drive sheave then engages the section of each rope extending between the car and counterweight.

In a preferred embodiment, each said movably mounted circular rim member comprises only one outer rim surface and said only one outer rim surface is arranged to engage only one rope. Thus, the rim member in question can provide individual tension control of the rope passing around it.

In a preferred embodiment, the maximal travel distance of the elevator car is preferably more than 100 meters, more preferably more than 200 meters, most preferably more than 300 meters.

In a preferred embodiment, each said rope is belt-shaped, i.e. substantially larger in width direction w than in thickness direction. The width/thickness ratio of the rope is then preferably more than 2.

In a preferred embodiment, each said rope is a flat belt or the rope has tooth pattern engaging counterpart tooth pattern of the outer rim surface of a circular rim member of the drive sheave, or the rope comprises a rib pattern of ribs parallel to longitudinal direction of the rope engaging counterpart rib pattern of the outer rim surface of a circular rim member of the drive sheave.

In a preferred embodiment, the elevator comprises a tension sensing means for sensing tension of one or more of the ropes passing around the drive sheave. Particularly preferably, the elevator comprises a tension sensing means for sensing individual tension of a rope passing around a rotatably mounted circular rim member of the drive sheave, the elevator being arranged to control rotation of said rotatably mounted circular rim member with said control means based on the sensed individual tension of said rope.

In a preferred embodiment, the elevator preferably comprises a tension sensing means for sensing individual tension of a rope passing around a rotatably mounted circular rim member, the elevator being arranged to compare the sensed individual tension of said rope with one or more reference tensions and to control rotation of said rotatably mounted circular rim member with said control means based on said comparison.

In a preferred embodiment, the elevator is configured to control rotation of said rotatably mounted circular rim member with said control means such that difference between said measured tension and said reference tension is reduced. The elevator control, for example, can be configured to perform said comparison.

In a preferred embodiment, the elevator, such as said elevator control, is configured to control said control means based on said comparison by sending electrical control signals via a wired or wireless connection to the control means.

In a preferred embodiment, each said tension sensing means comprise a torque sensor configured to measure torque of a control motor electrically controllable to rotate the rotatably mounted circular rim member.

In a preferred embodiment, said tension sensing means comprise a load sensors between the elevator car c and an end of a rope fixed to the elevator car c for sensing individual tension of said rope and/or a load sensor between the counterweight and an end of a rope fixed to counterweight for sensing individual tension of said rope. In an alternative solution (2:1 solution), said tension sensing means preferably comprise a sensor between an end of a rope fixed to a stationary fixing base (e.g. stationary structure of the building) on the elevator car side for sensing individual tension of said rope and/or a load sensor between an end of a rope fixed to a stationary fixing base (e.g. stationary structure of the building) on the counterweight side for sensing individual tension of said rope. Generally, the load sensor can comprise a force sensor, for example.

In a preferred embodiment, said reference tension comprises a preset tension or an average tension of measured tensions of plurality of ropes or measured individual tensions of one or other ropes of the elevator, for example.

In a preferred embodiment, if the individual measured tension exceeds a reference tension, such as an average tension of measured tensions of plurality of ropes or a measured individual tensions of one or other ropes of the elevator, the elevator is configured to control rotation of said rotatably mounted circular rim member with said control means to rotate such that measured tension is reduced.

In a preferred embodiment, the elevator comprises a park brake mounted on the car, such as a park brake for gripping a guide rail of the elevator, arranged to hold the car vertically immovable during its loading or unloading, and all of the circular rim members of the drive sheave are rotatably mounted circular rim members, each being rotatable by a control motor relative to the central cylinder and the elevator is configured to adjust rope tension during loading or unloading of the car by rotating the rotatably mounted circular rim members with said control means relative to the central cylinder. Hereby, vertical movement of the car occurring after releasing of the park brake can be reduced or completely eliminated. The elevator is preferably moreover configured to maintain said central cylinder immovable, preferably by aid of one or more machine brakes, and to perform said adjustment while the central cylinder is immovable.

The elevator is in general preferably such that it comprises an elevator car vertically movable to and from plurality of landings, i.e. two or more vertically displaced landings. Preferably, the elevator car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
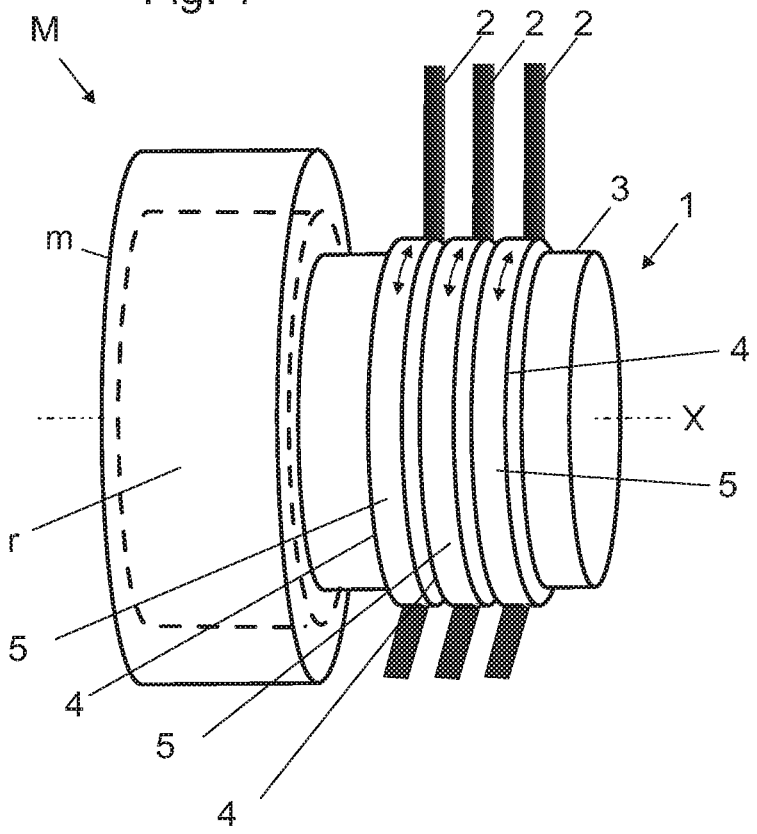
FIG. 1 illustrates a drive machinery for an elevator according to a preferred embodiment.

FIG. 1 illustrates a drive machinery M for an elevator according to a preferred embodiment. The drive machinery comprises a rotatable drive sheave 1 for driving plurality of ropes 2 of the elevator, the drive sheave 1 comprising a central cylinder 3, which comprises a central axis X around which the central cylinder 3 is rotatable, and a plurality of circular rim members 4 surrounding the central cylinder 3, each said circular rim member 4 comprising an outer rim surface 5 for engaging one of said ropes 2. The drive sheave 1 is arranged to exert traction force via the circular mounted circular rim members 4 on the ropes 2 passing around them.

The drive machinery M moreover comprises a motor m arranged to rotate the central cylinder 3 of the drive sheave 1. The motor m is preferably an electric motor.

Figure 2:
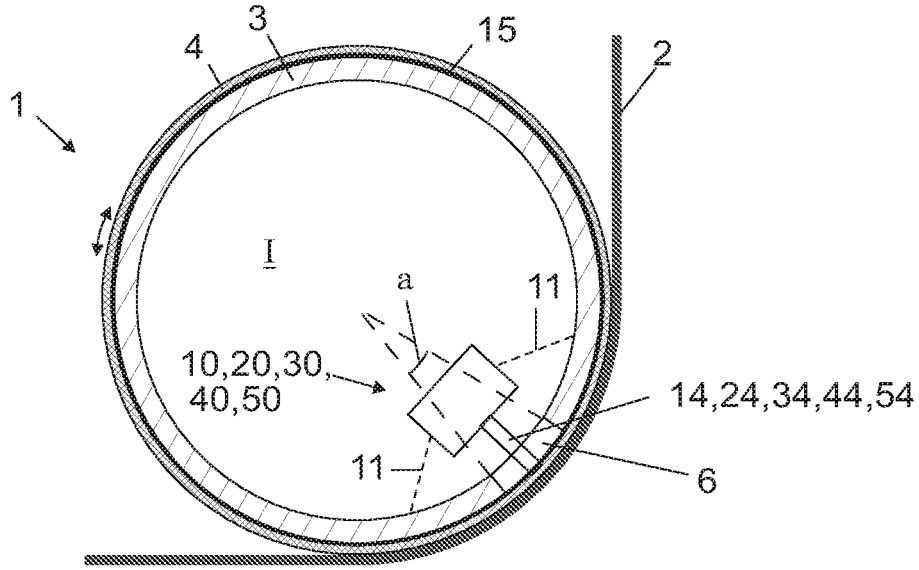
FIG. 2 illustrates a schematic cross sectional view of the drive sheave of the drive machinery of FIG. 1 as seen in direction of the central axis of the drive sheave.

FIG. 2 illustrates a schematic cross sectional view of the drive sheave 1 as seen in direction of the central axis X. Said plurality of circular rim members 4 includes rotatably mounted circular rim members 4, wherein each said rotatably mounted circular rim member 4 is mounted, preferably via bearings 15, on the central cylinder 3 rotatably around said central axis X relative to the central cylinder 3 and relative to the other circular rim members 4. The drive sheave 1 moreover comprises a control means 10, 20, 30, 40, 50 for controlling rotation of each said rotatably mounted circular rim member 4 relative to the central cylinder 3 and relative to the other circular rim members 4. With the control means 10, 20, 30, 40, 50, it is possible to control transmission of force between the central cylinder 3 and an individual rotatably mounted circular rim member 4. Hereby, a tension difference (which is generated by car position change) between a rope passing around said rotatably mounted circular rim member 4 and ropes 2 passing around the other circular rim members 4 can be eliminated.

In the preferred embodiment, each said movably mounted circular rim member 4 comprises only one outer rim surface 5, and said only one outer rim surface is suitable for/arranged to engaging only one rope 2.

Each said rotatably mounted circular rim member 4 is arranged to be rotated by the central cylinder 3 via the control means 10, 20, 30, 40, 50. The control means 10, 20, 30, 40, 50 are in particular arranged to transmit forces between the central cylinder 3 and the rotatably mounted circular rim member 4.

As mentioned, the motor m is arranged to rotate the central cylinder 3. For this purpose, the central cylinder 3 is preferably either directly fixed on or integral with the rotor r of the motor m. Alternatively, there could be a force transmission, such as gears, between the motor m and the central cylinder 3. In any case, it is preferable that the motor m for rotating the central cylinder 3 is arranged to produce forces for rotating the circular rim members 4, including the one or more rotatably mounted circular rim members 4, said forces being arranged to be transmitted from the motor m to the central cylinder and further therefrom to the rotatably mounted circular rim members 4 via the control means 10, 20, 30, 40, 50.

Each said rotatably mounted circular rim member 4 is mounted, preferably via bearings 15 on the central cylinder 3, said bearings 15 preferably including sliding bearings and/or rolling element bearings such as ball bearings or roller bearings, such that it is rotatable relative to the central cylinder 3 as well as relative to one or more of the other rim members 4 an unlimited rotation angle. Hereby, tension difference generated by car position change between a rope passing around said rotatably mounted circular rim member 4 and a rope 2 passing around the circular rim members 4 in question can be eliminated regardless of the amount of needed relative rotation. In a situation where non-idealities, if not eliminated, generate a great amount of excessive tension on a rope 2 on one side of the drive sheave 1 during one ride or cumulated in repeated elevator rides, elimination of the excessive tension requires a large amount of additional length of rope on that side. When a rotatably mounted circular rim member 4 is able to rotate an unlimited rotation angle relative to the other rim members 4, there is no upper limit for amount of excessive tension to be eliminated. Such tension differences cannot form in one ride regardless of the length of the ride nor accumulate during long term use which could not be eliminated by aid of the rotatably mounted circular rim member 4.

It is possible to make only one, all, or only some of the circular rim members 4 of the drive sheave 1 rotatably mounted as defined. It is however preferable that most, most preferably all or all but one, of said rim members 4 are rotatably mounted circular rim members as defined. Said plurality of circular rim members 4 consists of at least of 2 circular rim members 4, but most preferably, said plurality of circular rim members 4 consists of 3 or more circular rim members 4, such as of 3-15 circular rim members 4. As mentioned, it is possible to make all but one of said circular rim members 4 to be rotatably mounted circular rim members as defined. This facilitates safety and/or controllability, since this ensures that in no circumstances all the circular rim members 4 can move relative to the central cylinder 3. Although one circular rim member 4 is non-rotatable relative to the central cylinder 3, the tensions thereof relative to the other ropes 2 can still be controlled by controlling the other, movably mounted circular rim members 4. Thus, full freedom to control rope tensions is maintained despite one circular rim members 4 being non-rotatable relative to the central cylinder 3.

FIG. 2 illustrates schematically the spatial and functional inter-relationship of the control means 10, 20, 30, 40, 50 with the rotatable rim member 4 and the central cylinder 3.

The central cylinder 3 is at least partly hollow such that it comprises an inside space I for accommodating at least partly said control means 10, 20, 30, 40, 50.

The central cylinder 3 comprises one or more openings 6 leading radially out from the inside space I and the control means 10, 20, 30, 40, 50 comprise one or more operating members 14, 24, 34, 44, 54 extending via said one or more openings 6 into contact with the one or more rotatably mounted circular rim members 4. The central cylinder 3 may comprise such an opening 6 per each rotatably mounted circular rim members 4 when there are plurality of rotatably mounted circular rim members 4 controlled by the control means 10, 20, 30, 40, 50 or alternatively operating members 14, 24, 34, 44, 54 can extend via such an opening individually made in the central cylinder 3 for each rotatably mounted circular rim members 4 controlled by the control means 10, 20, 30, 40, 50 so that the control means 10, 20, 30, 40, 50 can comprise an operating member 14, 24, 34, 44, 54 and an opening 6 per each rotatably mounted circular rim members 4 controlled by the control means 10, 20, 30, 40, 50. In FIG. 2, the operating members 14, 24, 34, 44, 54 are illustrated schematically, and can be realized for example as illustrated in FIGS. 5-14.

In general, it is preferable that said opening 6 covers an angle a of the circumference of the central cylinder 3 which is less than 90 degrees. The length of said opening 6 as seen in direction of axis X and measured along outer circumference of the central cylinder 3 is preferably less than fourth of the length of said outer circumference.

Said control means 10, 20, 30, 40, 50 are mounted via a mounting means 11, 21, 31, 41, 51 on the central cylinder 3, whereby they are rotatable together with the central cylinder 3 around said central axis X. Said control means 10, 20, 30, 40, 50 are particularly rotatable together with the central cylinder 3 around said central axis X together with the central cylinder 3 with the same rotational speed of the central cylinder 3 regardless of the rotational speed of the central cylinder 3.

Figure 3:
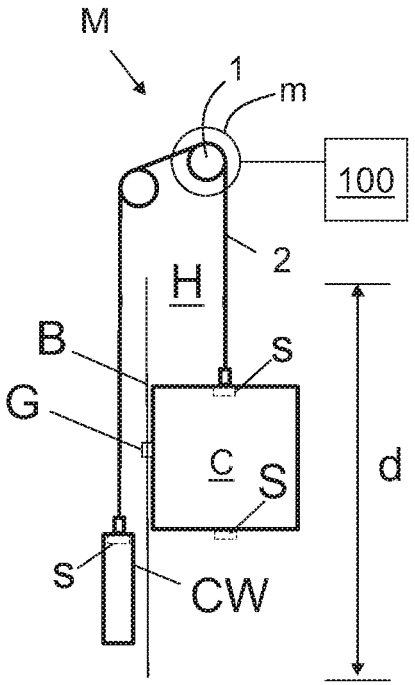
FIG. 3 illustrates an embodiment of an elevator implementing the drive machinery of FIG. 1.

FIG. 3 illustrates a preferred embodiment of an elevator according to the invention. The elevator comprises a drive machinery M as described above and plurality of ropes 2 arranged to pass around the drive sheave 1 thereof.

The elevator comprises a hoistway H, and an elevator car C vertically moveable in the hoistway H, and an elevator control 100, which is configured to automatically control the motor m of the machinery M. The elevator comprises plurality of ropes 2 passing around the drive sheave 1, each resting against an outer rim surface 5 of the drive sheave 1. The elevator moreover comprises a counterweight CW and the ropes 2 interconnect the car C and counterweight CW. The drive sheave 1 engages the section of each rope 2 extending between the car C and counterweight CW.

The maximal travel distance d of the elevator car C, that is the distance between the uppermost position and the lowermost position of the car C during elevator use to serve passengers, which are realized when the car C (in particular the sill thereof) is level with the uppermost landing (in particular the sill thereof) where the car C can be driven and when the car C (in particular the sill thereof) is level with the lowermost landing (in particular the sill thereof) where the car C can be driven, respectively, is preferably more than 100 meters, more preferably more than 200 meters, possibly more than 300 meters, because the longer the travel distance, the more advantageous the solution is. In this case, it is particularly preferable that each said rotatably mounted circular rim member 4 is mounted, preferably via bearings 15 on the central cylinder 3, said bearings 15 preferably including sliding bearings and/or rolling element bearings such as ball bearings or roller bearings, such that it is rotatable relative to the central cylinder 3 as well as relative to one or more of the other rim members 4 an unlimited rotation angle.

Figure 4:
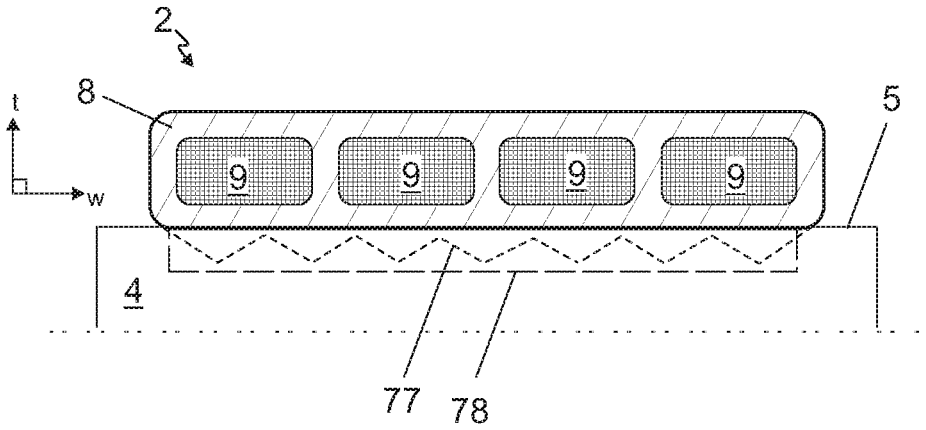
FIG. 4 illustrates preferred details of the rope utilized in combination with the drive machinery of FIG. 1.

FIG. 4 illustrates preferred details of the rope 2. In this case, the rope 2 is such that it can engages with an outer rim surface 5 of a drive sheave 1 such that little or virtually no slip can occur between the rope 2 and the outer rim surface 5 of the drive sheave 1. In the embodiment illustrated this is due to the rope comprising an outer surface material comprising polymer. More specifically, in the presented embodiment, the rope comprises load bearing members 9 extending in longitudinal direction of the rope 2 throughout the length thereof and embedded in a coating 8 forming the outer surface of the rope 2. The coating 8 comprises polymer material such as polyurethane for example, or alternatively rubber or silicone. The coating 8 is in contact with the outer rim surface 5 of a rim member 4 of the drive sheave 1. The rope 2 is moreover belt-shaped, i.e. substantially larger in width direction w than in thickness direction, which increases firmness of engagement between it and the drive sheave 1. This rope-shape thereby in its part reduces likelihood of slip between the rope 2 and the outer rim surface 5 of the drive sheave 1, and thereby the presented solution is advantageous with this kind of rope 2. The belt can be a flat belt, for example. Likelihood of slip is even lower if the rope 2 has tooth pattern engaging counterpart tooth pattern of the outer rim surface 5 of a rim member 4 of the drive sheave 1, or if the rope 2 comprises a rib pattern of ribs parallel to longitudinal direction of the rope engaging counterpart rib pattern of the outer rim surface 5 of a circular rim member 4 of the drive sheave 1, said alternative and optional patterns being presented in FIG. 4 in broken lines 77 and 78. At least some of the advantages of the invention can be achieved also with other shapes and materials of the rope 2, such as with ropes having round cross-section and comprising an outer surface material comprising polymer.

Figure 5:
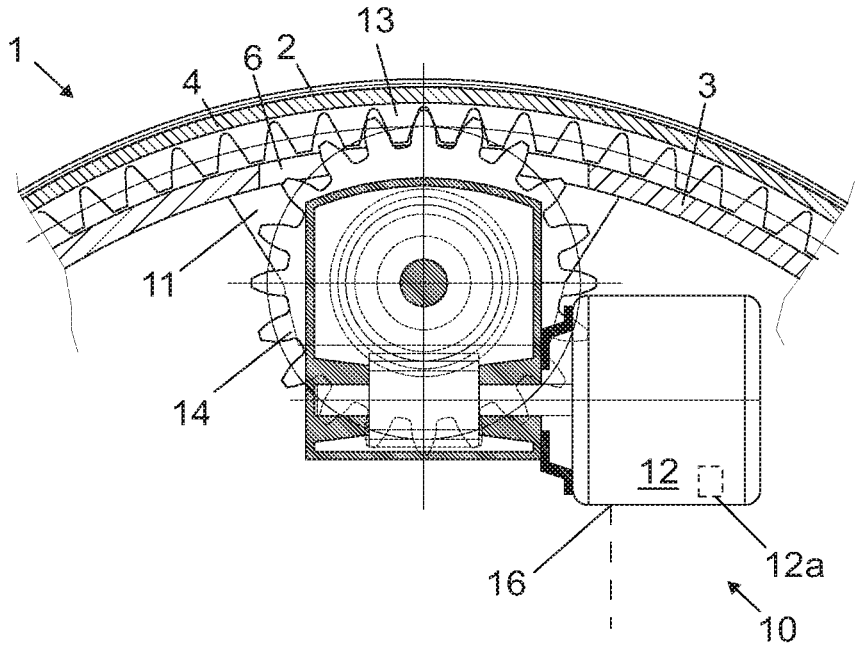
FIGS. 5 and 6 illustrate preferred details of a first kind for the drive machinery of FIG. 1.
Figure 6:
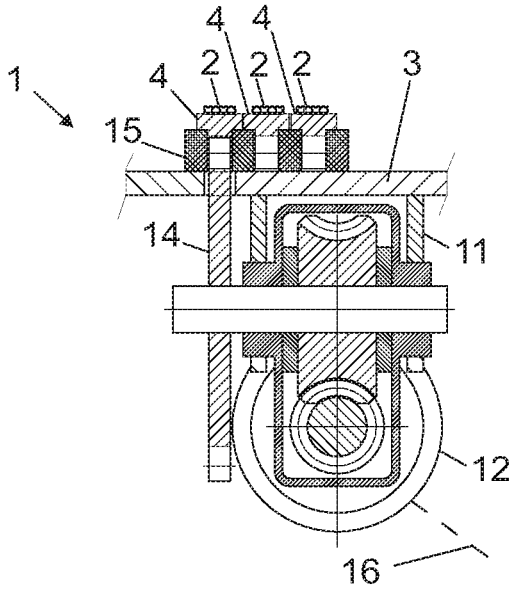

FIGS. 5 and 6 illustrate preferred details of a first kind of preferred implementation of the aforementioned control means for controlling rotation of each said rotatably mounted circular rim member 4 relative to the central cylinder 3 and relative to one or more of the other circular rim members 4. In the presented case, said means 10 comprises a motor 12 electrically controllable to rotate the rotatably mounted circular rim member 4 relative to the central cylinder 3 as well as relative to one or more of the other rim members 4.

The motor 12 is electrically controllable to reduce or increase the angular velocity of the rotatably mounted circular rim member 4 relative to the angular velocity of the central cylinder and other circular rim members 4 of the drive sheave 1, in particular during rotation of the central cylinder 3. The rotatably mounted circular rim member 4 can thus be controlled to rotate with an angular velocity different from the angular velocity of the central cylinder and other circular rim members 4. Thus, also the angle rotated by the rotatably mounted circular rim member 4 is question is controllable to be different than that of the central cylinder 3 and the other circular rim members 4 of the drive sheave 1. Hereby, tension differences between the rope 2 passing around the rotatably mounted circular rim member 4 is question and the other ropes passing around the other rim members 4 can be reduced.

The motor 12 is operatively connected to the rotatably mounted circular rim member 4 by force transmission.

The motor 12 is operatively connected to only one rotatably mounted circular rim member 4 (the leftmost in FIG. 6), whereby rotation of this rotatably mounted circular rim member 4 can be individually controlled by said motor 12, i.e. independently of movement of other rim members 4.

One or more of the other rim members 4 can be also rotatable mounted and each of them can be correspondingly provided with a motor electrically controllable to rotate the rim member 4 in question. Thus, they can each be individually controlled by a motor, i.e. independently of movement of other rim members 4.

As illustrated, said force transmission is preferably such that said rotatably mounted circular rim member 4 comprises a tooth pattern 13 and said motor 12 is arranged to rotate a toothed sheave 14 meshing with said tooth pattern. Preferably, diameter of the toothed sheave 14 is substantially smaller than diameter of the rim member, most preferably having diameter less than half the diameter of the rim member, whereby opening 6 can be made small.

In the preferred embodiment presented, said toothed sheave 14 has rotational axis parallel with the aforementioned central axis X.

In the preferred embodiment presented, said rotatably mounted circular rim member 4 comprises said tooth pattern 13 on its inner side facing towards the central axis X.

The tooth pattern 13 is preferably circular forming a full circle of teeth. It here forms a full circle of teeth along inner side of said rotatably mounted circular rim member 4. Thus, the tooth pattern does not limit angle of rotation between the rotatably mounted circular rim member 4 and the central cylinder.

In the preferred embodiment presented, the motor 12 is rigidly mounted on the central cylinder 3, in particular on inner side of the central cylinder 3 which side faces towards the central axis X.

Said motor 12 preferably comprises an input 16 for a control signal, which can be a control signal transmitted via wired or wireless connection.

Figure 7:
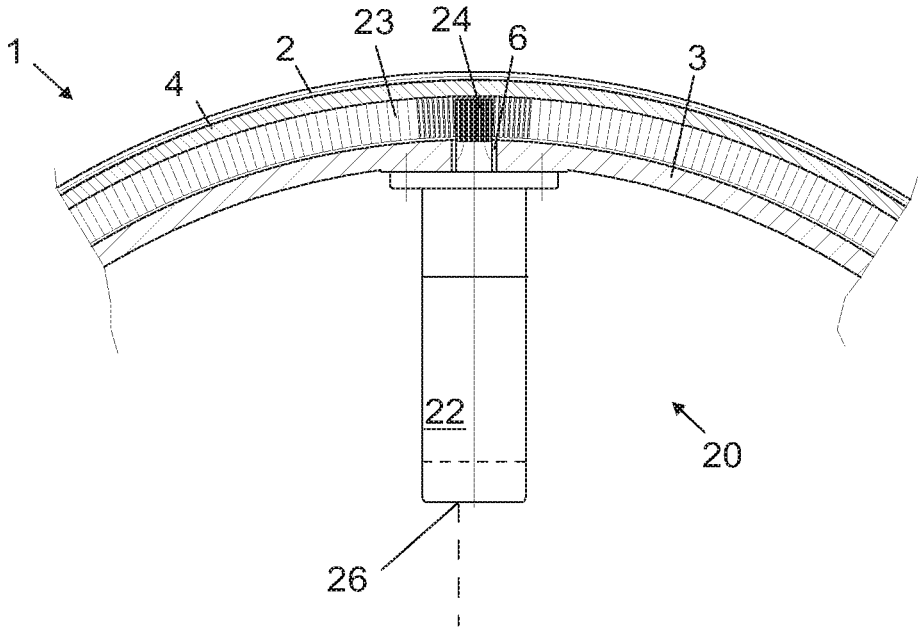
FIGS. 7 and 8 illustrate preferred details of a second kind for the drive machinery of FIG. 1.
Figure 8:
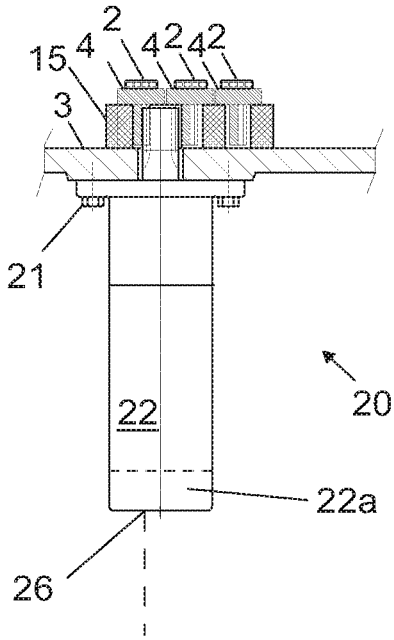

FIGS. 7 and 8 illustrate preferred details of a second kind of preferred implementation of the aforementioned control means for controlling rotation of each said rotatably mounted circular rim member (4) relative to the central cylinder (3) and relative to one or more of the other circular rim members 4. In the presented case, said means 10 comprises a motor 22 electrically controllable to rotate the rotatably mounted circular rim member 4 relative to the central cylinder 3 as well as relative to one or more of the other rim members 4.

The motor 22 is electrically controllable to reduce or increase the angular velocity of the rotatably mounted circular rim member 4 relative to the angular velocity of the central cylinder 3 and other circular rim members 4 of the drive sheave 1, in particular during rotation of the central cylinder 3. The rotatably mounted circular rim member 4 can thus be controlled to rotate with an angular velocity different from the angular velocity of the central cylinder 3 and other circular rim members 4.

The motor 22 is operatively connected to the rotatably mounted circular rim member 4 by force transmission.

The motor 22 is operatively connected to only one rotatably mounted circular rim member 4 (the leftmost in FIG. 8), whereby rotation of this rotatably mounted circular rim member 4 can be individually controlled by said motor 22, i.e. independently of movement of other rim members 4.

One or more of the other rim members 4 can be also rotatable mounted and each of them can be correspondingly provided with a motor electrically controllable to rotate the rim member 4 in question. Thus, they can each be individually controlled by a motor, i.e. independently of movement of other rim members 4.

As illustrated, said force transmission is preferably such that said rotatably mounted circular rim member 4 comprises a tooth pattern 23 and said motor 22 is arranged to rotate a toothed sheave 24 meshing with said tooth pattern. Preferably, diameter of the toothed sheave 24 is substantially smaller than diameter of the rim member, most preferably less than half thereof, whereby opening 6 can be made small.

In the preferred embodiment presented, said toothed sheave 24 has rotational axis orthogonal to the aforementioned central axis X. This provides that the opening(s) 6 leading radially out from the inside space I can be made very small, which is advantageous for rigidity and manufacturing of the central cylinder 3. Said toothed sheave 24 is preferably positioned outside the central cylinder 3, whereby opening(s) 6 leading radially out from the inside space I can be made extremely small.

In the preferred embodiment presented, said rotatably mounted circular rim member 4 comprises said tooth pattern 23 on its side facing in longitudinal direction of the central axis X.

The tooth pattern 23 is preferably circular forming a full circle of teeth. It here forms a full circle of teeth along the side of said rotatably mounted circular rim member 4 facing in longitudinal direction of the central axis X. Thus, the tooth pattern 23 does not limit angle of rotation between the rotatably mounted circular rim member 4 and the central cylinder 3.

In the preferred embodiment presented, the motor 22 has rotational axis orthogonal to the aforementioned central axis X. The motor may have an integrated torque sensor 22*a*, and the motor 22 can be configured to be controlled based on torque measurement obtained by aid of said sensor 22*a*.

In the preferred embodiment presented, the motor 22 is rigidly mounted on the central cylinder 3, in particular on inner side of the central cylinder 3 which side faces towards the central axis X.

Said motor 22 preferably comprises an input 26 for a control signal, which can be a control signal transmitted via wired or wireless connection.

Figure 9:
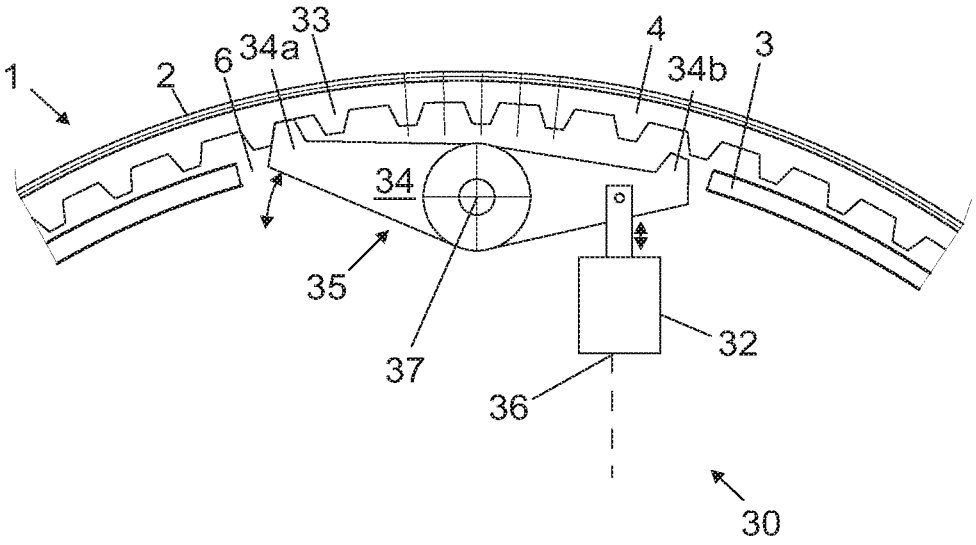
FIGS. 9 and 10 illustrate preferred details of a third kind for the drive machinery of FIG. 1.
Figure 10:
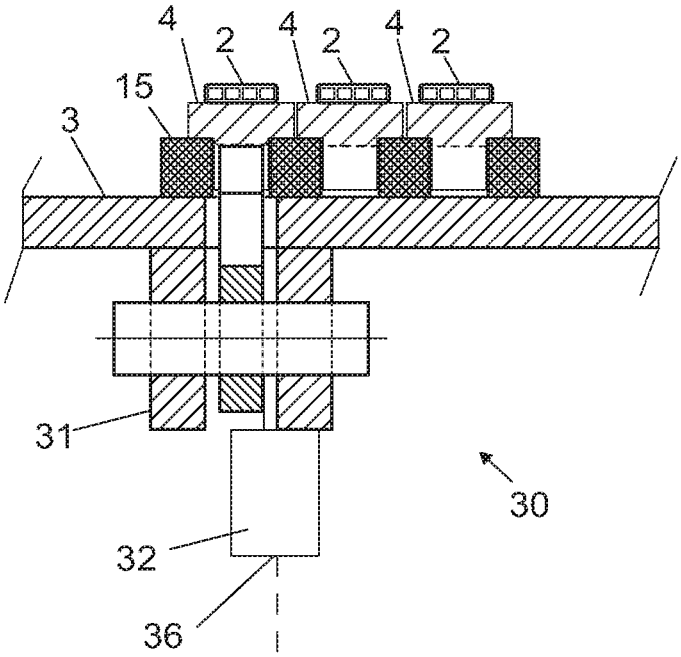

FIGS. 9 and 10 illustrate preferred details of a third kind of preferred implementation of the aforementioned control means for controlling rotation of each said rotatably mounted circular rim member 4 relative to the central cylinder 3 and relative to one or more of the other circular rim members 4.

In this embodiment, said control means 30 comprises a releasable locking mechanism 35 for locking the rotatably mounted circular rim member 4 to be immovable relative to the central cylinder 3, which releasable locking mechanism 35 is releasable to allow rotation of the rotatably mounted circular rim member 4 relative to the central cylinder 3 as well as relative to one or more of the other rim members 4, said control means 30 further comprising an electrically controllable actuator 32 for moving said locking mechanism 35 between released and locked state.

The releasable locking mechanism 35 comprises a tooth pattern 33 provided on the rotatably mounted circular rim member 4, and a locking member 34 comprising one or more parts 34*a*, 34*b* movable to and from a space between two teeth of the tooth pattern 33 for changing the state of the locking mechanism 35.

The tooth pattern 33 is preferably circular forming a full circle of teeth.

In the preferred embodiment presented, said rotatably mounted circular rim member 4 comprises said tooth pattern 33 on its inner side facing towards the central axis X. Then, the locking member 34 is preferably at least partly inside the inside space I of the central cylinder 3.

In the preferred embodiment presented, the locking member 34 is a pendulum pivotal back and forth around an axis 37, in particular by said electrically controllable actuator 32 alone or possibly together with other actuators or spring members, the pendulum comprising one or more parts 34*a*, 34*b*, in particular distal end parts, movable by pivoting to and from a space between two teeth of the tooth pattern 33 for changing the state of the locking mechanism 35. Preferably, there are two of said parts 34*a*, 34*b* arranged such that one of said parts 34*a*, 34*b* is between two teeth of the tooth pattern 33 when the other of said parts 34*a*, 34*b* is not between two teeth of the tooth pattern 33, and vice versa. The pendulum 34 having two of said parts 34*a*, 34*b* arranged in this way, provides that the rotatable rim member 4 can be allowed to rotate stepwise to the direction of greater rope force by repeating state changes of the locking mechanism 35.

Said actuator 32 preferably comprises an input 36 for an electrical control signal, which can be a control signal transmitted via wired or wireless connection. Said actuator 32 can be in the form of an electromagnet (e.g. solenoid), whereby via the input electricity to energize the electromagnet against a return spring can be supplied. The control signal can be a change in supply of electricity, such as interruption of supply of electricity, for example.

In this embodiment, as it is with all the embodiments, it is preferable, although not necessary that each said rotatably mounted circular rim member 4 is mounted via bearings 15 on the central cylinder 3, said bearings 15 preferably including sliding bearings and/or rolling element bearings such as ball bearings or roller bearings, such that it is rotatable relative to the central cylinder 3 as well as relative to one or more of the other rim members 4 an unlimited rotation angle. Bearings 15 facilitate generally rotation of the rotatably mounted circular rim member 4, whereby rope tension equalization can be simply and reliably performed. In the embodiment of FIGS. 9-10, actuation of the pendulum allows the toothed rotatable rim member 4 rotate to the direction of greater rope force.

Figure 11:
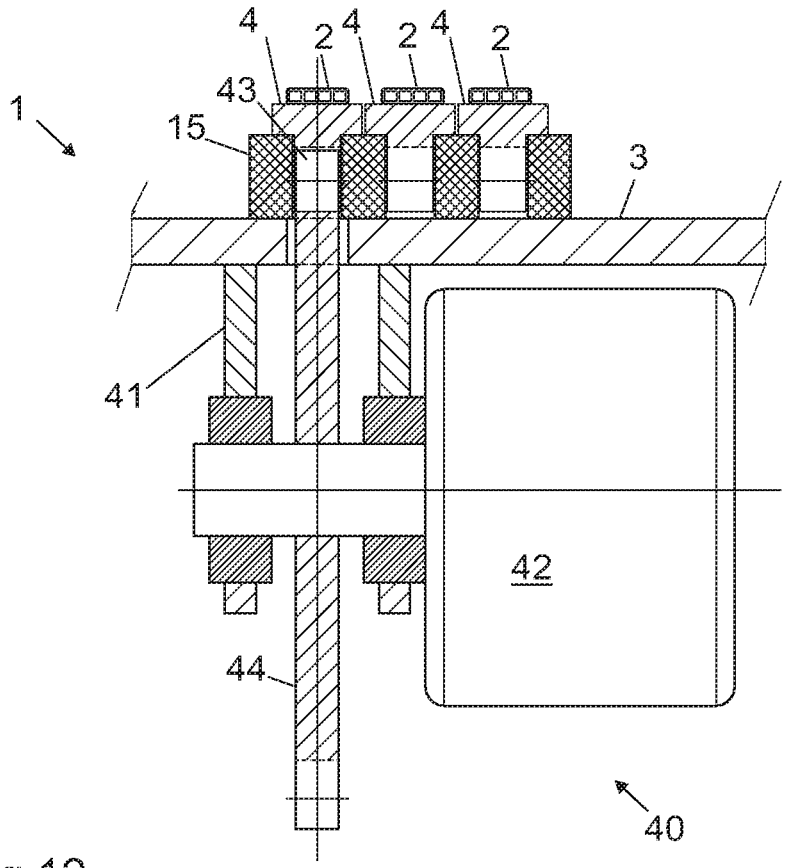
FIGS. 11 and 12 illustrate preferred details of a fourth kind for the drive machinery of FIG. 1.
Figure 12:
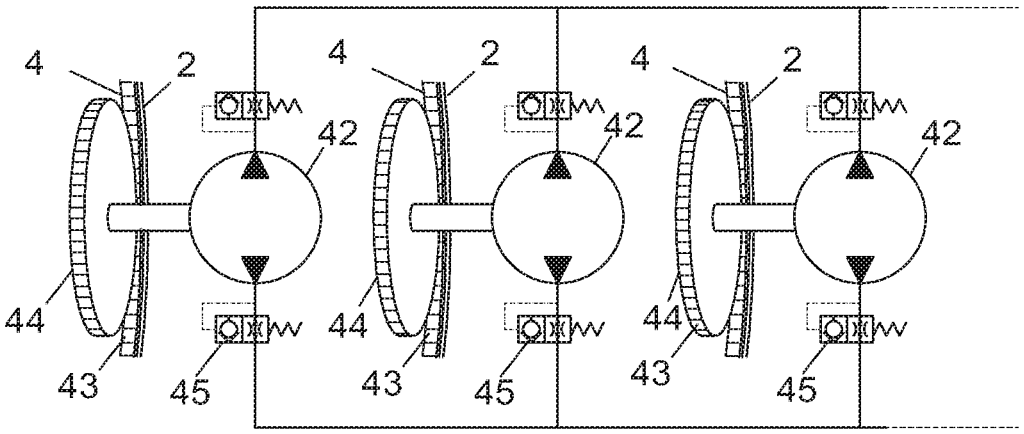

FIGS. 11 and 12 illustrate preferred details of a fourth kind of preferred implementation of the aforementioned control means for controlling rotation of each said rotatably mounted circular rim member 4 relative to the central cylinder 3 and relative to one or more of the other circular rim members 4.

In this embodiment, said control means 40 comprises a hydraulic motor 42 operatively connected to a rotatably mounted circular rim member 4 for rotating it relative to the central cylinder 3 as well as relative 4 to one or more of the other rim members 4. In particular, said means 40 comprises plurality of hydraulic motors 42 each operatively connected to only one rotatably mounted circular rim member 4 for rotating it relative to the central cylinder 3 as well as relative to one or more of the other rim members 4, all said hydraulic motors 42 being rotatable by hydraulic fluid supplied to all said hydraulic motors 42 with equal pressure. Thus, the rotatably mounted circular rim member 4 are hydraulically connected which ensures that equal torque will be directed on them by the drive sheave 1. This embodiment does not necessitate active control actions by the elevator control.

The input passage of each hydraulic motor 42 is preferably provided with a non-return valve 45. This prevents uncontrolled movement of the elevator car if one or more rotatably mounted circular rim members 4 lose torque (e.g. rope is cut).

Preferably, said motor 42 has rotational axis parallel with the aforementioned central axis X. Preferably, said rotatably mounted circular rim member 4 comprises a tooth pattern 43 on its inner side facing towards the central axis X and said motor 42 is arranged to rotate a toothed sheave 44 meshing with said tooth pattern 43. Said toothed sheave 44 has rotational axis parallel with the aforementioned central axis X.

Figure 13:
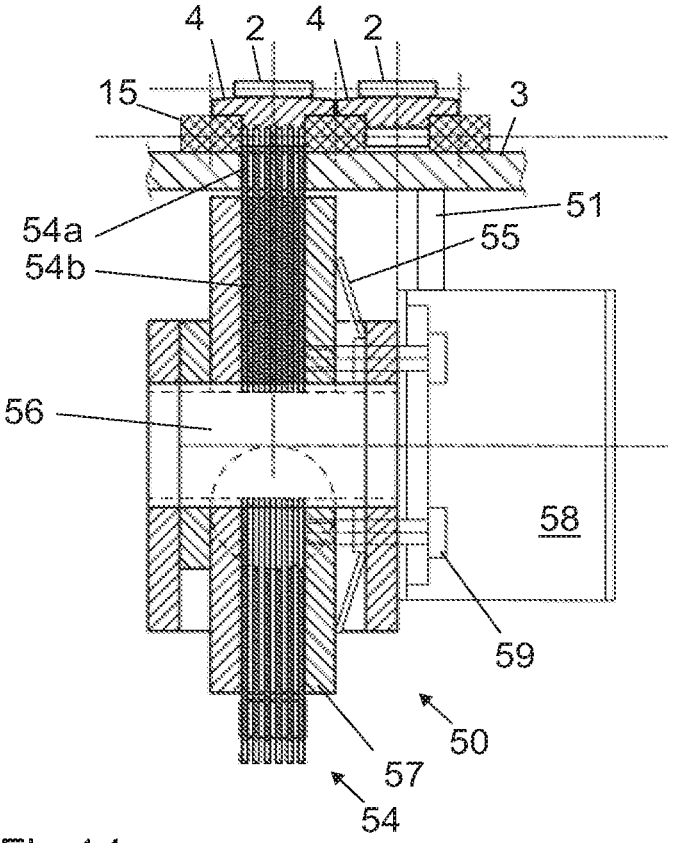
FIG. 13 illustrates preferred details of a fifth kind for the drive machinery of FIG. 1.

FIG. 13 illustrates preferred details of a fifth kind of preferred implementation of the aforementioned control means for controlling rotation of each said rotatably mounted circular rim member 4 relative to the central cylinder 3 and relative to one or more of the other circular rim members 4.

In this embodiment, said control means 50 comprises a brake 54-56 for braking rotation of the rotatably mounted circular rim member 4 relative to the central cylinder 3, and a controlling means 58 for controlling the brake 54-56.

In the preferred embodiment illustrated in FIG. 13, the brake 54-56 comprises a pack of wheels 54 including engagement wheels 54*a* engaging a rotatably mounted circular rim member 4 with a positive engagement (teeth), the engagement wheels 54*a* being mounted on a shaft 56 of the pack 54 rotatably such that they can be rotated by the rotatably mounted circular rim member 4 when it rotates relative to the central cylinder 3. The pack of wheels 54 moreover comprises clutch wheels 54*b* mounted on the shaft 56 of the pack 54 unrotatably, and the brake comprises a compression means 55, such as a spring, for compressing the engagement wheels 54*a* and clutch wheels 54*b* together such that clutch wheels resist rotation of the engagement wheels. By controlling the compression, amount of braking of the rotatably mounted circular rim member 4 can be controlled. For this purpose, said controlling means 58 for controlling the brake 54-56 are able to relieve said compression.

In the preferred embodiment presented, the compression means 55 is a spring arranged to compress the wheels 54*a*, 54*b* in axial direction of the shaft 56 against each other via an end plate 57. Thus, the spring presses the rotatable engagement wheels 54*a* against the clutch wheels 54*b* mounted on the shaft 56 of the pack 54 unrotatably, which has the effect that the rotation of the engagement wheels 54*a* is blocked, which has the effect that rotation of the rotatably mounted circular rim member 4 is also blocked. When the compression is relieved, the rotatable engagement wheels 54*a* are not any more tightly against the clutch wheels 54*b*, and the rotatable engagement wheels 54*a* are freed to rotate. Rotation of the engagement wheels 54*a* has the effect that the rotatably mounted circular rim member 4 can rotate to the direction of greater rope force.

In the preferred embodiment presented, controlling means 58 for controlling the brake 54-56 are provided for moving the end plate 57, particularly by pulling it via members 59 fixed to the end plate 57, away from the wheels 54*a*, 54*b* in axial direction of the shaft 56 against compression of said spring 55.

The controlling means 58 can be an electrically controllable actuator for example, such as a electromagnet (e.g. a solenoid).

Figure 14:
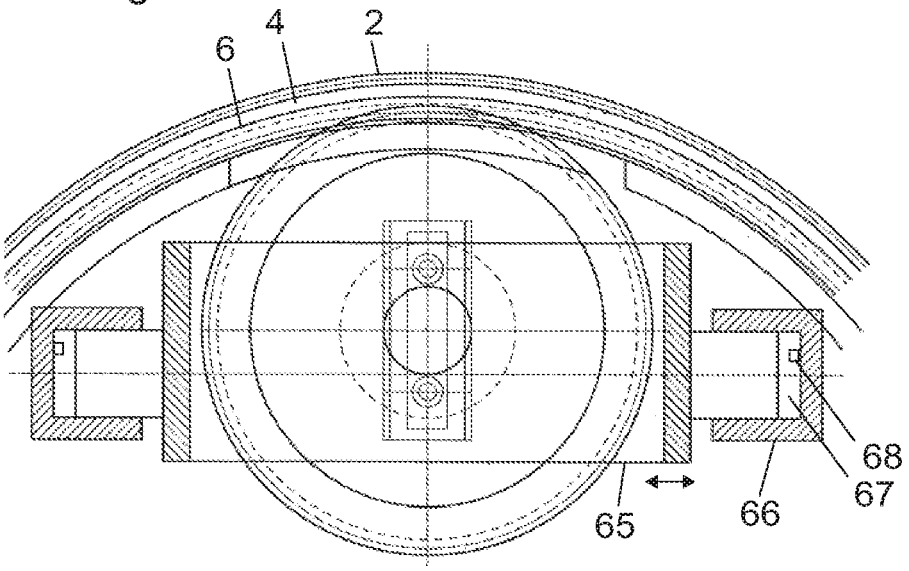
FIGS. 14 and 15 illustrate preferred further details for the solution of FIG. 13.

FIG. 14 illustrates details of a preferred implementation of the embodiment of FIG. 13. In the implementation of FIG. 14, the drive machinery moreover comprises a mounting means 65, 66 by which said pack 54 is mounted movably such that it can be moved by force exerted by the rotatably mounted circular rim member 4 on said engagement plates 54*a* against a hydraulic pressure in a hydraulic chamber 67. The drive machinery 1 moreover comprises a sensor 68 for sensing this hydraulic pressure, and the controlling means 58, which are then preferably in the form of an electrically controllable actuator for example, can be arranged to relieve the aforementioned compression based on said hydraulic pressure, particularly to relieve said compression when said hydraulic pressure exceeds a reference pressure.

Figure 15:
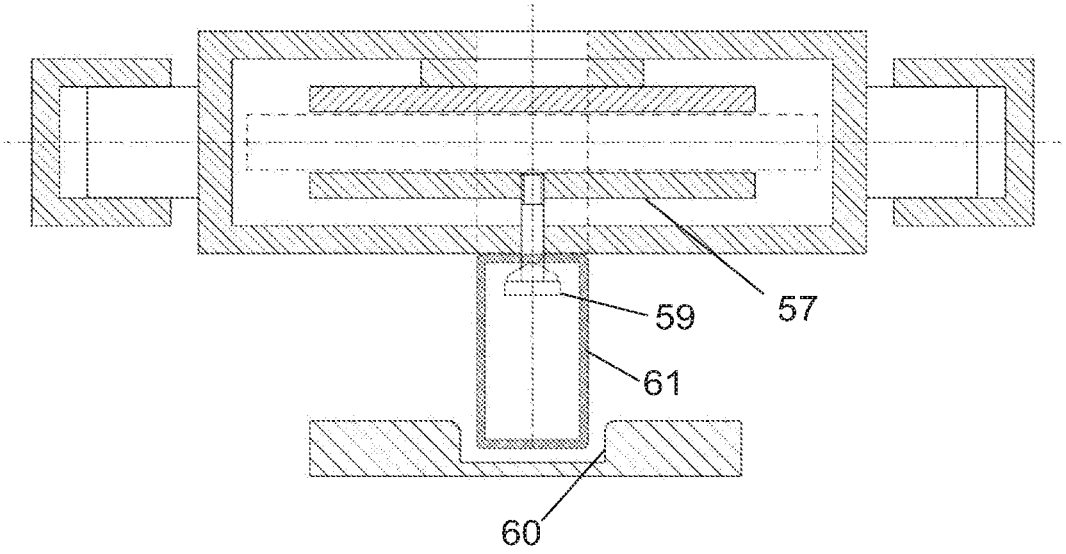

FIG. 15 illustrates details of a modified implementation of the embodiment of FIG. 14 operating passively. In this case, the controlling means 58 need not comprise an electrically controllable actuator. In this case the arrangement performing the actuation can operate autonomously without rope tension measurement.

In the implementation of FIG. 15 modifying the implementation of FIG. 14, the controlling means 58 comprises, as disclosed in FIG. 14, a mounting means 65, 66 by which said pack 54 is mounted movably such that it can be moved by force exerted by the rotatably mounted circular rim member 4 on said engagement plates 54*a* against a hydraulic pressure in a hydraulic chamber 67. In this modified implementation, the controlling means 58 comprises a mechanism for relieving the aforementioned compression of the pack 54 when the pack is moved to a preset position. In said position, there can be an abutment member 60, and the pack 54 can comprise an operating member 61, which when colliding with the abutment member 60, is arranged to move such that it pulls the end plate 57 of the pack 54 via members 59 fixed to the end plate 57, away from the wheels 54*a*, 54*b* in axial direction of the shaft 56 against compression of said spring 55. Thus, displacement of the pack to this position initiates relieve of the brake and thereby allows the rotatable rim member 4 acted on by the brake in question, to rotate an amount. This also allows the pack 54 to return from the preset position moved by the hydraulic pressure in said chamber 67. The hydraulic chamber 67 is preferably in fluid connection with a hydraulic chamber of a corresponding brake acting on a different movably mounted circular rim member 4. Thus, tension differences become equalized effectively.

In general, the elevator preferably comprises a tension sensing means s,12*a*, 22*a* for sensing individual tension t1 of a rope 2 passing around a rotatably mounted circular rim member 4, the elevator being arranged to control rotation of said rotatably mounted circular rim member with said control means 10, 20, 30, 40, 50 based on the sensed individual tension (t1) of said rope 2. It is more precisely, preferable that the elevator is arranged to compare the sensed individual tension (t1) of said rope 2 with one or more reference tensions and to control said control means 10, 20, 30, 40, 50 based on said comparison.

The elevator is configured to control rotation of said rotatably mounted circular rim member with said control means 10, 20, 30, 40, 50 such that difference between said measured individual tension (t1) and said reference tension is reduced.

Should the individual measured tension (t1) exceed a reference tension, such as an average tension of plurality of ropes 2 or a measured individual tensions of one or other ropes 2 of the elevator, the elevator is configured to control rotation of said rotatably mounted circular rim member with said control means 10, 20, 30, 40, 50 to rotate such that the individual measured tension (t1) is reduced.

Said reference tension can comprise a preset tension or an average tension of measured tensions of plurality of ropes 2 or measured individual tensions of one or other ropes 2 of the elevator, for example.

The elevator control 100, for example, can be configured to perform said comparison.

Figure 16:
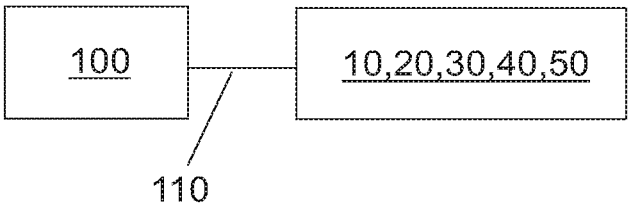
FIG. 16 illustrates preferred control connections of the control means of the drive machine or FIG. 1.

The elevator, such as said elevator control 100, is configured to control said control means 10, 20, 30, 40, 50 based on said comparison by sending electrical control signals via a wired or wireless connection 110 to the control means 10, 20, 30, 40, 50. FIG. 16 illustrates preferred control connections of the control means of the drive machine or FIG. 1. Electrical signals can preferably be transmitted in both directions via the connection 110.

The tension sensing means 12*a*, 22*a* can comprise, as presented in FIGS. 5-8, a torque sensor 12*a*, 22*a* configured to measure torque of a motor 12, 22 electrically controllable to rotate the rotatably mounted circular rim member 4. Alternatively or additionally, as illustrated in FIG. 3, said tension sensing means can comprise a load sensor s between the elevator car c and an end of a rope fixed to the elevator car c for sensing individual tension of said rope 2 and/or a load sensor between the counterweight and an end of a rope fixed to counterweight for sensing individual tension of said rope 2. The load sensor can comprise a force sensor, for example. In a 2:1 solution, the sensor s would be between an end of a rope fixed to a stationary fixing base (e.g. stationary structure of the building) on the elevator car c side for sensing individual tension of said rope 2 and/or a load sensor between an end of a rope fixed to a stationary fixing base (e.g. stationary structure of the building) on the counterweight side for sensing individual tension of said rope 2

Generally, the control means can have an additional or alternative purpose to adjust rope tension of the ropes 2 of the elevator during loading or unloading of the car C so as to decrease or eliminate drop or jump of the car C after release of a car brake B. The elevator is then configured to adjust rope tension during loading or unloading of the car C by rotating the rotatably mounted circular rim members 4 with said control means 10, 20, 30, 40, 50 relative to the central cylinder 3, in particular such that vertical movement of the car after release of a park brake is reduced or eliminated. In this case, the elevator comprises a park brake G mounted on the car C, such as a park brake for gripping a guide rail B of the elevator, arranged to hold the car C vertically immovable during its loading or unloading.

It is preferable that all of the circular rim members 4 of the drive sheave 1 are rotatably mounted circular rim members 4, each being rotatable by a control motor 12, 22 relative to the central cylinder 3 and the elevator is configured to adjust rope tension during loading or unloading of the car C by rotating the rotatably mounted circular rim members 4. Hereby, vertical movement of the car C occurring after releasing of the park brake G can be effectively reduced or completely eliminated.

The elevator is preferably moreover configured to maintain said central cylinder 3 immovable, preferably by aid of one or more machine brakes of the drive machinery M (not showed) acting on the central cylinder 3 (e.g. by frictional engagement), and to perform said adjustment while the central cylinder 3 is immovable. An advantage is that the motor m of the drive machinery M need not be used for said adjustment.

The aforementioned adjustment is particularly facilitated when all of the circular rim members of the drive sheave are rotatably mounted circular rim members, each being rotatable by a control motor 12, 22 relative to the central cylinder 3. Preferably, although not necessarily, the control means 10, 20 then comprises a control motor 12, 22 per each said rotatably mounted circular rim member 4, which control motor 12, 22 is electrically controllable to rotate the rotatably mounted circular rim member 4 in question relative to the central cylinder 3.

The aforementioned adjustment of the rope tension can be performed in response to changes in load state of the car, such as in response to changes in measured load of the car C. For measuring load of the car C, there can be a car load sensor S mounted on the car, for example. The car load sensor S may be for example arranged to weigh load placed on the car floor.

For example, in response to sensed increase in car load, the elevator can be configured to rotate the mounted circular rim members for pulling the elevator car (slowly) upwards to increase the tensions of the ropes 2, in particular tensions of the rope sections (of said ropes 2) extending between the car C and the drive sheave 1. Thus, after release of park brake G, the car does not move below the landing level even although the load has been increased.

Correspondingly, in response to sensed decrease in car load, the elevator can be configured to rotate the rotatably mounted circular rim members 4 such that the tension of the ropes 2, in particular tensions of the rope sections (of said ropes 2) extending between the car C and the drive sheave 1, pulling the elevator car upwards is reduced. Thus, after release of park brake G, the car does not move above the landing level even although the load has been increased.

It is to be understood that the above description and the accompanying Figures are only intended to teach the best way known to the inventors to make and use the invention.

It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. A drive machinery for an elevator comprising:

a rotatable drive sheave for driving plurality of ropes of the elevator, the rotatable drive sheave including, a central cylinder having a central axis around which the central cylinder is rotatable;

a plurality of circular rim members surrounding the central cylinder, the plurality of circular rim members each having an outer rim surface for engaging a rope, the plurality of circular rim members includes one or more rotatably mounted circular rim members, each of the one or more rotatably mounted circular rim members being mounted on the central cylinder rotatably around said central axis relative to the central cylinder and relative to one or more of other ones of the plurality of circular rim members; and a control device mounted on the central cylinder, the control device configured to control rotation of each of the one or more rotatably mounted circular rim members relative to the central cylinder and relative to the other ones of the plurality of circular rim members.

2. The drive machinery according to claim 1, wherein said control device is electrically controllable.

3. The drive machinery according to claim 1, wherein each of the one or more rotatably mounted circular rim members is arranged to be rotated by the central cylinder via the control device.

4. The drive machinery according to claim 1, wherein the drive machinery further comprises:

a motor for rotating the central cylinder.

5. The drive machinery according to claim 4, wherein the motor for rotating the central cylinder is arranged to produce forces for rotating the one or more rotatably mounted circular rim members, said forces being arranged to be transmitted from the motor to the central cylinder and further therefrom to the one or more rotatably mounted circular rim members via the control device.

6. The drive machinery according to claim 1, wherein each of the one or more rotatably mounted circular rim members is mounted via bearings on the central cylinder, said bearings including one or more of sliding bearings or rolling element bearings.

7. The drive machinery according to claim 1, wherein each of the one or more rotatably mounted circular rim members is mounted, preferably via bearings on the central cylinder, said bearings including one or more of sliding bearings or rolling element bearings such that the one or more rotatably mounted circular rim members is rotatable relative to the central cylinder as well as relative to the other ones of the plurality of circular rim members an unlimited rotation angle.

8. The drive machinery according to claim 1, wherein the central cylinder is at least partly hollow such that the central cylinder comprises an inside space for accommodating at least partly said control device.

9. The drive machinery according to claim 1, wherein the central cylinder has one or more openings leading radially out from an inside space, and the control device comprise one or more operating members extending, via said one or more openings into contact with the one or more rotatably mounted circular rim members.

10. The drive machinery according to claim 1, wherein said control device comprises:

a control motor electrically controllable to rotate the one or more rotatably mounted circular rim members relative to the central cylinder as well as relative to the other ones of the plurality of circular rim members.

11. The drive machinery according to claim 10, wherein said control motor is electrically controllable to reduce or increase an angular velocity of the one or more rotatably mounted circular rim members relative to the angular velocity of one or more of the central cylinder or the other ones of the plurality of circular rim members.

12. The drive machinery according to claim 10, wherein the one or more rotatably mounted circular rim members each have a tooth pattern, and wherein said control motor is arranged to rotate a toothed sheave meshing with said tooth pattern, the tooth pattern being circular forming a full circle of teeth.

13. The drive machinery according to claim 1, wherein said control device comprises:

a releasable locking mechanism for locking the one or more rotatably mounted circular rim members to be immovable relative to the central cylinder, which releasable locking mechanism is releasable to allow rotation of the one or more rotatably mounted circular rim members relative to the central cylinder as well as relative to the other ones of the plurality of circular rim members, and an electrically controllable actuator for moving the releasable locking mechanism between released and locked state.

14. The drive machinery according to claim 1, wherein said control device comprises:

a hydraulic motor operatively connected to the one or more rotatably mounted circular rim members for rotating it the one or more rotatably mounted circular rim members relative to the central cylinder as well as relative to the other ones of the plurality of circular rim members.

15. The drive machinery according to claim 1, wherein said control device comprises:

a brake for braking rotation of the one or more rotatably mounted circular rim members relative to the central cylinder, and a controller configured to control the brake.

16. An elevator comprising:

the drive machinery of claim 1, and the plurality of ropes arranged to pass around the drive rotatable sheave.

17. The elevator according to claim 16, wherein each of the plurality of ropes includes a coating made from a polymer material forming an outer surface thereof, wherein the coating is in contact with the outer rim surface of the plurality of circular rim members of the rotatable drive sheave.

18. The elevator according to claim 16, wherein the elevator further comprises:

a tension sensor configured to sense individual tension of one of the plurality of ropes passing around the one or more rotatably mounted circular rim members, the elevator being arranged to control rotation of the one or more rotatably mounted circular rim members with said control device based on the individual tension of the one of the plurality of ropes.

19. The elevator according to claim 18, wherein the elevator is arranged to, compare the individual tension of the one of the plurality of ropes with one or more reference tensions to generate a comparison result, and control rotation of the one or more rotatably mounted circular rim members with said control device based on the comparison result.

20. The elevator according to claim 19, wherein the elevator is configured to control rotation of the one or more rotatably mounted circular rim members with said control device such that difference between the individual tension and the one or more reference tensions is reduced.

21. A rotatable drive sheave for driving plurality of ropes of the elevator, the rotatable drive sheave comprising:

a central cylinder having a central axis around which the central cylinder is rotatable;

a plurality of circular rim members surrounding the central cylinder, the plurality of circular rim members each having an outer rim surface for engaging a rope, the plurality of circular rim members includes one or more rotatably mounted circular rim members, each of the one or more rotatably mounted circular rim members being mounted on the central cylinder rotatably around said central axis relative to the central cylinder and relative to one or more of other ones of the plurality of circular rim members; and a control device mounted on the central cylinder, the control device configured to control rotation of each of the one or more rotatably mounted circular rim members relative to the central cylinder and relative to the other ones of the plurality of circular rim members.

* * * * *